US007312680B2

(12) United States Patent
Wang

(10) Patent No.: US 7,312,680 B2
(45) Date of Patent: Dec. 25, 2007

(54) MANUAL SWITCH-OFF DEVICE OF A PERMANENT MAGNET SWITCH OPERATING MECHANISM

(76) Inventor: GuangShun Wang, No. 1 WeiXu North Road, AnQiu, ShangDong Province (CN) 262100

( * ) Notice: Subject to any disclaimer, the term of this patent is extended or adjusted under 35 U.S.C. 154(b) by 191 days.

(21) Appl. No.: 11/318,722

(22) Filed: Dec. 27, 2005

(65) Prior Publication Data

US 2006/0162194 A1 Jul. 27, 2006

(30) Foreign Application Priority Data

Jan. 25, 2005 (CN) ..... 2005 1 0042050

(51) Int. Cl.
*H01H 7/08* (2006.01)

(52) U.S. Cl. ..... 335/238; 74/25; 74/36

(58) Field of Classification Search ..... 335/238; 251/129.03; 74/25, 36
See application file for complete search history.

(56) References Cited

U.S. PATENT DOCUMENTS 3,254,660 A * 6/1966 Ray ..... 137/66
5,372,351 A * 12/1994 Oliver ..... 251/65

FOREIGN PATENT DOCUMENTS

CN 98220417.5 9/1999

* cited by examiner

*Primary Examiner*—Ramon M. Barrera
(74) *Attorney, Agent, or Firm*—Hamre, Schumann, Mueller & Larson, P.C.

(57) ABSTRACT

The present invention relates to a device that allows an output shaft to perform axial motion and automatic locking, in particular, a manual switch-off device for a permanent magnet switch operating mechanism. A large shoe plate and a small shoe plate are fixed onto a base plate. A transmission shaft is rotatably installed onto the large shoe plate and the small shoe plate that are in parallel with each other. An eccentric wheel is fixed onto the transmission shaft between the large shoe plate and the small shoe plate. An output shaft in parallel with the large shoe plate and the small shoe plate is installed onto the base plate. One end of the output shaft is fixed with an end cap. The large shoe plate has an open slot. The eccentric wheel has a spring column fixed thereon, and the spring column connects to one end of a manual switch-off spring through the open slot. The other end of the manual switch-off spring hooks to a spring mount point on the large shoe plate. The device is simple in structure, low in failure rate, and quick in manual switch-off action. With the permanent magnet operating mechanism, it can be used for tens of thousands of times with no malfunction, and thus no maintenance is needed.

10 Claims, 4 Drawing Sheets

MANUAL SWITCH-OFF DEVICE OF A PERMANENT MAGNET SWITCH OPERATING MECHANISM

FIELD OF INVENTION

This invention relates to a device that allows output shaft to perform axial motion. In particular, it relates to a manual switch-off device for a permanent magnet switch operating mechanism. Certainly, it also can be used for some other similar occasions.

BACKGROUND OF THE INVENTION

The existing power switches use electromagnetic operating mechanism or spring operating mechanism to perform switch-off and switch-on actions. The electromagnetic operating mechanism has deficiencies in that it requires additional mechanical locking device, and has complex structure, high failure rate, high noise level and short service life. The spring operating mechanism requires being driven by a motor and locked in mechanical mode, with complex structure, heavy weight, slow movement, high noise level and high failure rate. In addition, a permanent magnet monostable operating mechanism has been developed in recent years, which has a more complex structure than a bistable one, especially the manual switch-off device of which still basically adopts conventional releasing principle, with large number of parts and complex structure that cause frequent malfunction of the locking part. The manual switch-off devices of the above operating mechanisms all operate with the normal actions of the mechanism, and has short service life due to frequent operations. Another CN patent owned by the Applicant, Patent No. ZL98220417.5 (Title: a permanent magnet operation mechanism for vacuum switch) discloses an operating mechanism that uses electromagnetic force to perform switch-off/switch-on and uses magnetic force of a permanent magnet to perform locking operation. Such an operating mechanism has simple structure and low failure rate. However, the operating mechanism has deficiencies that due to extremely large attraction force of the permanent magnet, once the electromagnet coil and the trip circuit have malfunction, it may be difficult to perform emergency switch-off manually, and the manual switch-off mechanism based on common lever principle cannot ensure stable switch-off speed. The essence of the permanent magnet operating mechanism is to allow an output shaft to perform axial motion, so as to perform switch-off/switch-on actions. However, up to now there has not been a manual switch-off device that is simple, reliable and that complies with the technical requirements in the field.

SUMMARY OF THE INVENTION

The object of the present invention is to provide a manual switch-off device for a permanent magnet switch operating mechanism that has simple structure and low failure rate. The device allows an output shaft of the permanent magnet mechanism to perform axial motion and to lock bilaterally, and the device complies with technical requirements for manual switch-off power switch.

To achieve the above objects, the present invention provides the following technical solutions:

A manual switch-off device for a permanent magnet switch operating mechanism of the present invention includes a large shoe plate and a small shoe plate fixed onto a base plate in parallel, a transmission shaft rotatably installed onto the large shoe plate and the small shoe plate, an eccentric wheel fixed onto the transmission shaft between the large shoe plate and the small shoe plate, and an output shaft installed onto the base plate in parallel with the large shoe plate and the small shoe plate. One end of the output shaft has an end cap. The large shoe plate has an open slot. The eccentric wheel has a spring column fixed thereon, and the spring column connects to one end of a manual switch-off spring through the open slot. The other end of the manual switch-off spring hooks to a spring mount point on the large shoe plate. The spring mount point is located above central extension line of the spring column and the transmission shaft under switch-on state, to satisfy the requirement of the spring column passing the dead point when switching on.

The end cap is in hinge joint with the output shaft through a connecting pin.

The eccentric wheel is shaped in disk, and connects to the transmission shaft through a fixed point on the center of the disk.

The eccentric wheel is an elliptic wheel or other non-linear curve wheel.

The transmission shaft has a single direction switch-off handle.

The eccentric wheel and the transmission shaft are so connected, when manually rotating the transmission shaft towards switch-off direction, the eccentric wheel rotates along the transmission shaft, so that the tangency point of the eccentric wheel and the end cap moves towards switch-off direction, to lift up the end cap, and thus to pull the output shaft to one side, to allow the output shaft to perform axial motion. In addition, the operating mechanism has the following advantages:

1) It is simple in structure, low in failure rate, and satisfies the requirements for manually switching off the permanent magnet mechanism.
2) It needs small manual operation force, and is safe and reliable.
3) It acts quickly for manual switch-off, and the speed of which is stable.
4) When performing normal switch-on/switch-off, the rotating parts of the mechanism is locked by spring, so as to greatly improve the service life.
5) Since the permanent magnet mechanism has been invented, its application is limited because the manual switch-off issue cannot be solved. The present invention solves the key technical problems in the application of the permanent magnet mechanism, and thus greatly pushing the progress of the power switch operating mechanism.

DETAILED DESCRIPTION OF THE PREFERRED EMBODIMENT

Figure 1:
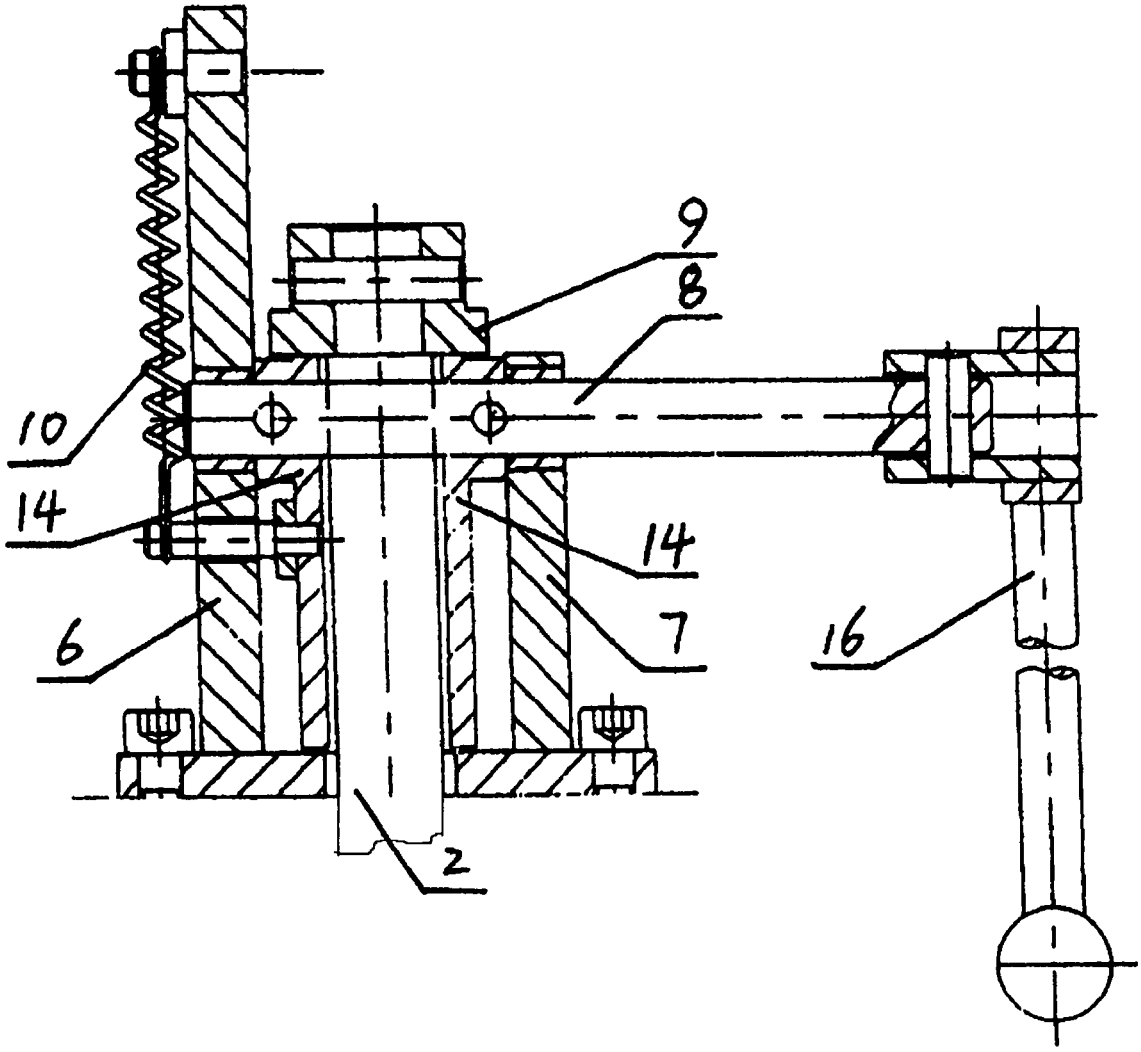
FIG. 1 is a sectional view according to one embodiment of the present invention.

As shown in FIG. 1, a manual switch-off device for a permanent magnet switch operating mechanism of the present invention includes a large shoe plate 6 and a small shoe plate 7 fixed onto a base plate in parallel, and a transmission shaft 8 rotatably installed onto the large shoe plate 6 and the small shoe plate 7. One end of the transmission shaft 8 has a handle. An eccentric wheel 14 is fixed onto the transmission shaft 8 between the large shoe plate 6 and the small shoe plate 7. An output shaft 2 parallel with the large shoe plate 6 and the small shoe plate 7 is installed onto the base plate. One end of the output shaft 2 has an end cap 9, which is in hinge joint with the output shaft 2 through a connecting pin. The large shoe plate 6 has an open slot. The eccentric wheel 14 has a spring column fixed thereon, which connects to one end of a manual switch-off spring 10 through the open slot. The other end of the manual switch-off spring 10 hooks to a spring mount point on the large shoe plate 6. The spring column of the eccentric wheel 14 and the spring mount point of the large shoe plate 6 shall be placed at two ends of axes of the transmission shaft 8 respectively, and slightly pass over spring "dead point" in initial position, while the lowest point of the eccentric wheel 14 offsets the base plate so that it cannot continuously rotate. When action is required, an external force can be applied to allow the eccentric wheel 14 to rotate reversely to pass over the spring "dead point". The pull of the spring rotates the eccentric wheel 14, and lifts up the end cap by means of the eccentric wheel edge, to drive the output shaft. Since the end cap 9 is in hinge joint with the output shaft 2 through the connecting pin, when the eccentric wheel 14 lifts up the end cap 9, the end cap 9 may slightly swing, to relieve the friction between the two, so as to improve the service life of the parts.

Figure 2:
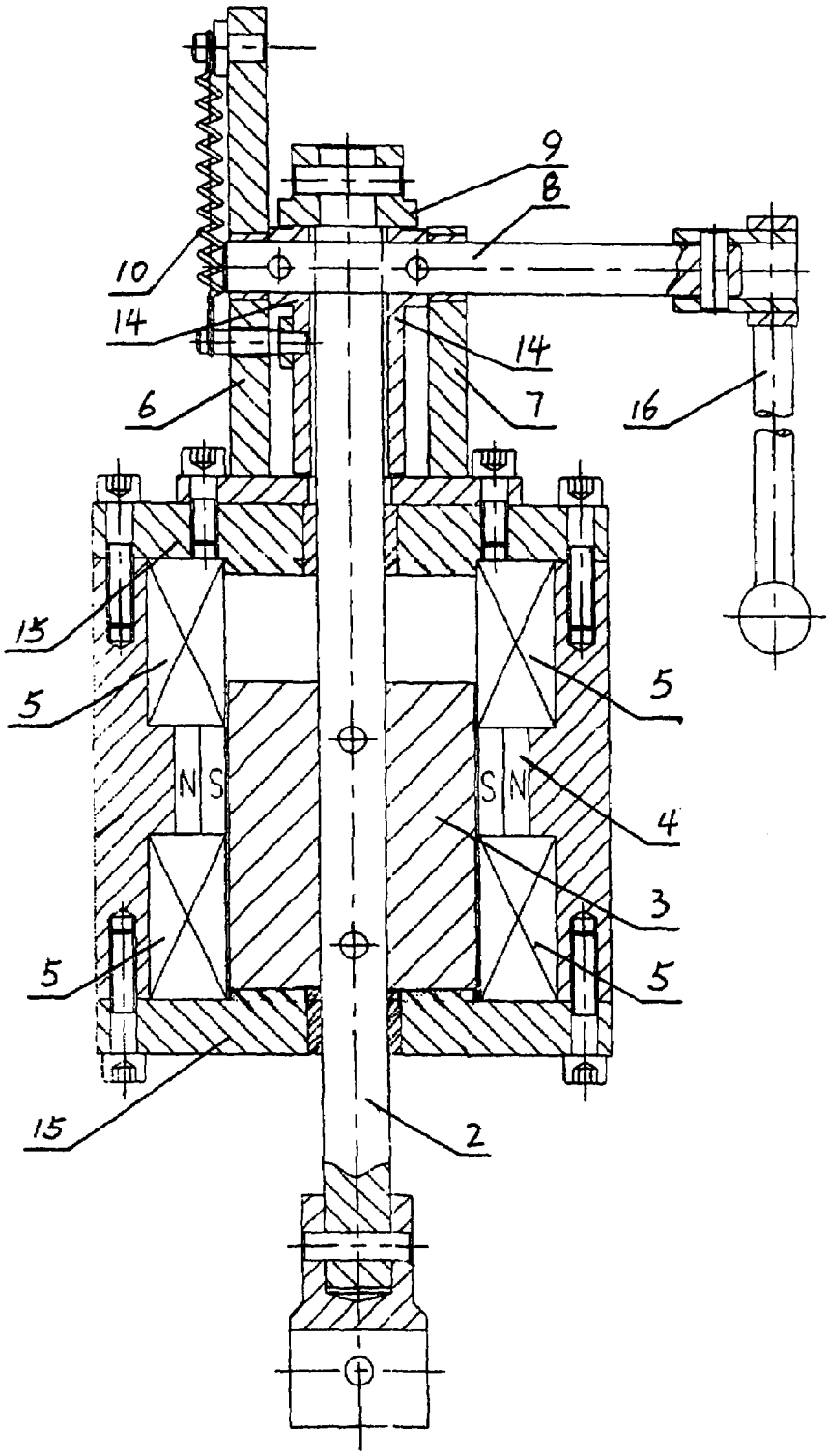
FIG. 2 is a sectional view of one embodiment of the present invention used in a permanent magnet switch operating mechanism.
Figure 3:
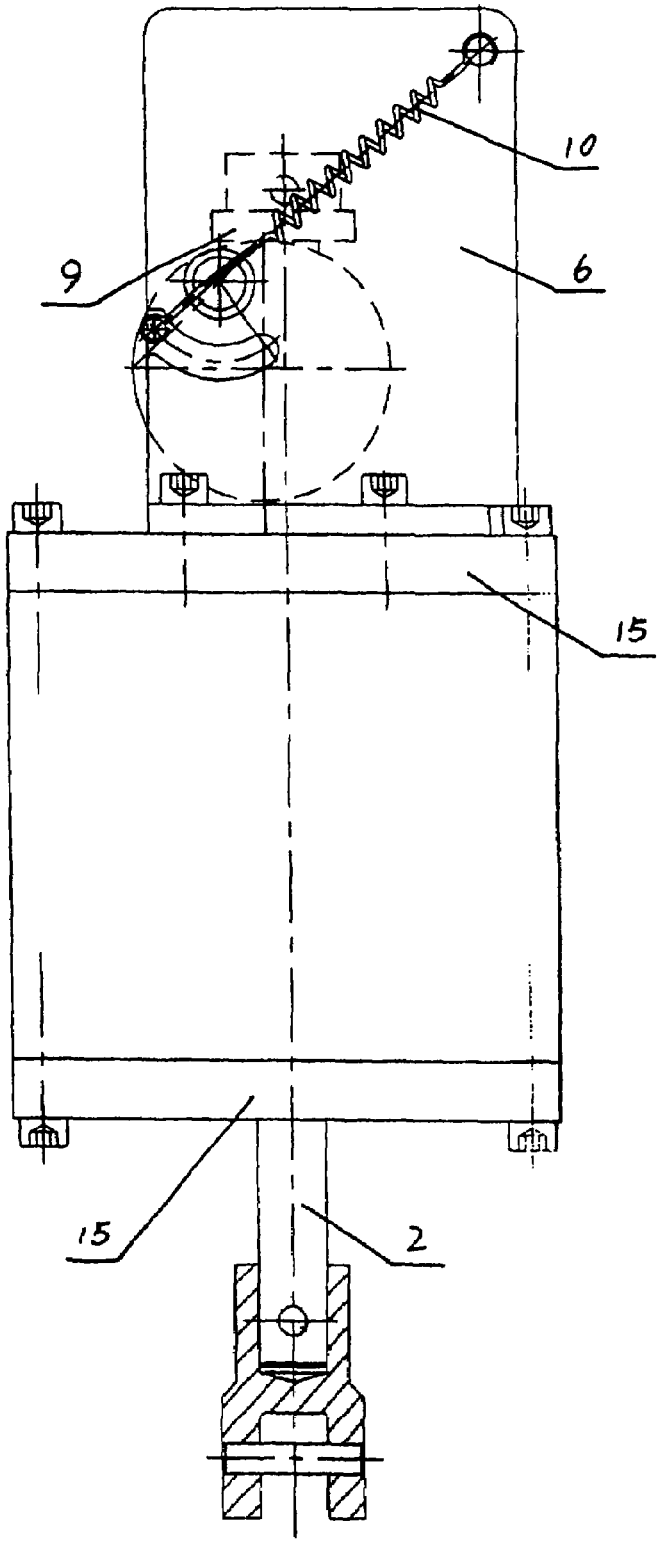
FIG. 3 is a left view of FIG. 2.
Figure 4:
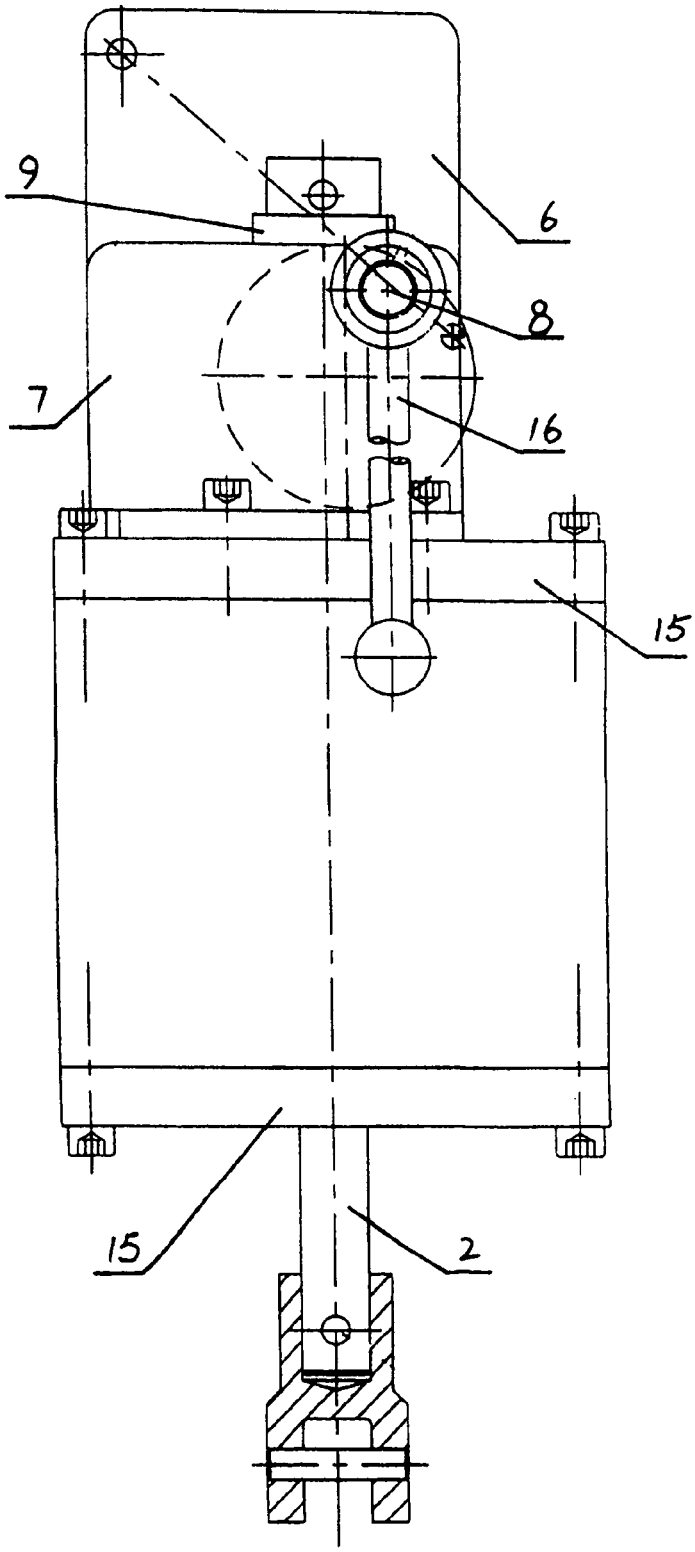
FIG. 4 is a right view of FIG. 2.

Application of the present invention will be described in detail below with FIGS. 2, 3, and 4. CN Patent No. ZL98220417.5 discloses a permanent magnet operation mechanism for vacuum switch, which is an operating mechanism for switching on/switching off a power switch. It has advantages such as simple structure and high reliability. It operates in a way that allows output shaft to reciprocate along the axes. Due to the permanent magnet between two end-caps 15 has bistable state, when a core 3 moves close to one side of the end-cap 15, the core 3 is attached to the end-cap 15 by magnetic force. When switch state needs to be changed, by imposing an electric current opposite to the attraction force of the permanent magnet on an electromagnetic coil 5, the core 3 will be pushed to the other side of the end-cap 15 and be attached to it by magnetic force of a permanent magnet 4. Thus, the power switch can perform actions.

A manual switch-off mechanism for a permanent magnet switch operating mechanism of the present invention is installed on the end-cap 15 of the above-described operating mechanism. When the operating mechanism operates normally, the manual switch-off device does not act. The manual switch-off spring 10 locks the transmission shaft 8 by using the principle of passing "dead point", to stop the transmission shaft 8 to rotate at discretion. Here the operating mechanism of the switch performs switch-on/switch-off by means of the magnetic force of the electromagnetic coil 5. When the electromagnetic coil 5 has malfunction and cannot perform switch-off, one only needs to pull a handle 16 on the transmission shaft 8 to rotate the transmission shaft 8 to a certain angle, upon the mount point of the manual switch-off spring 10 passes "dead point" (extension line connecting the mount point and the axes of the transmission shaft 8), with the pull of the manual switch-off spring 10, the eccentric wheel 14 rotates quickly to push the end cap 9 and the output shaft to rapidly move, so as to achieve quick manual switch-off. Upon the electromagnetic coil 5 resumes normal operation, re-use the electromagnetic coil to perform switch-on, the end cap 9 presses the eccentric wheel 14 to rotate in a direction opposite to the one for switching-off, and the spring mount point on the eccentric wheel 14 pulls the spring. When the spring mount point on the eccentric wheel 14 passes "dead point", the eccentric wheel 14 rotates a stable angle under the spring force to reach a stable point, and store spring energy for the next manual switch-off. Upon the eccentric wheel 14 reaches the stable point, due to the stable angle, the manual switch-off device does not act when in normal operation of switch-on/switch-off. After switching on, the manual switch-off spring will not pose counterforce against the attraction force of the permanent magnet, so as to ensure that the pressure on the switch contact will not decrease.

The eccentric wheel 14 changes the ratio between power arm and resisting arm with the rotation angle of the eccentric wheel 14. When initiating manual switch-off, the ratio of the arms is very big, the output shaft 2 overcomes resistance from the permanent magnet with a small force, and moves towards switch-off direction. With increasing rotating angle of the eccentric wheel 14, the ratio of the arms gradually reduces, and the moving speed of the output shaft 2 increases constantly under the joint effect of external force and the manual switch-off spring force, to achieve rapid switch-off. Upon the manual switch-off handle rotates to a certain angle, it mainly uses the manual switch-off spring 10 to perform switch-off, and thus to avoid instability caused by human factors on the switch-off speed.

The shape of the eccentric wheel 14 decides changes of the moving speed of the output shaft 2. In practice, the eccentric wheel 14 can be designed in a shape of circular, elliptical or other non-linear curve.

Certainly, the application of the present invention is not limited as discussed above. The present invention can be used in any similar devices that require driving the output shaft for axial motion.

We claim:

1. A manual switch-off device for a permanent magnet switch operating mechanism, characterized in:

the device includes a large shoe plate and a small shoe plate fixed onto a base plate in parallel, a transmission shaft rotatably installed onto the large shoe plate and the small shoe plate, an eccentric wheel fixed onto the transmission shaft between the large shoe plate and the small shoe plate, and an output shaft installed onto the base plate in parallel with the large shoe plate and the small shoe plate;

in which one end of the output shaft has an end cap;, the large shoe plate has an open slot; the eccentric wheel has a spring column fixed thereon, and the spring column connects to one end of a manual switch-off spring through the open slot; the other end of the manual switch-off spring hooks to a spring mount point on the large shoe plate; the spring mount point being located above central extension line of the spring column and the transmission shaft under switch-on state, to satisfy requirement of the spring column passing dead point upon switching on.

2. The manual switch-off device for a permanent magnet switch operating mechanism according to claim 1, in which the end cap is in hinge joint with the output shaft through a connecting pin.

3. The manual switch-off device for a permanent magnet switch operating mechanism according to claim 1, in which the eccentric wheel is in a disk shape, and is connected to the transmission shaft through a fixed point on a disk center.

4. The manual switch-off device for a permanent magnet switch operating mechanism according to claim 2, in which the eccentric wheel is in a disk shape, and is connected to the transmission shaft through a fixed point on a disk center.

5. The manual switch-off device for a permanent magnet switch operating mechanism according to claim 1, in which the eccentric wheel is an elliptic wheel.

6. The manual switch-off device for a permanent magnet switch operating mechanism according to claim 2, in which the eccentric wheel is an elliptic wheel.

7. The manual switch-off device for a permanent magnet switch operating mechanism according to claim 1, in which edge of the eccentric wheel is a non-linear curve that allows a switch-off arm to increase with increasing rotating angle when performing manual switch-off.

8. The manual switch-off device for a permanent magnet switch operating mechanism according to claim 2, in which edge of the eccentric wheel is a non-linear curve that allows a switch-off arm to increase with increasing rotating angle when performing manual switch-off.

9. The manual switch-off device for a permanent magnet switch operating mechanism according to claim 1, in which the transmission shaft has a single direction switch-off handle thereon.

10. The manual switch-off device for a permanent magnet switch operating mechanism according to claim 2, in which the transmission shaft has a single direction switch-off handle thereon.

* * * * *